US006826356B1

(12) United States Patent
Wanecski

(10) Patent No.: US 6,826,356 B1
(45) Date of Patent: Nov. 30, 2004

(54) SYSTEM AND METHOD FOR WATER HEATER PROTECTION

(75) Inventor: Eugene C. Wanecski, 12455 Porter Rd., Medina, NY (US) 14103

(73) Assignee: Eugene C. Wanecski, Medina, NY (US)

( * ) Notice: Subject to any disclaimer, the term of this patent is extended or adjusted under 35 U.S.C. 154(b) by 0 days.

(21) Appl. No.: 10/673,577

(22) Filed: Sep. 30, 2003

(51) Int. Cl.[7] ..... F24H 1/18
(52) U.S. Cl. ..... 392/449; 392/441
(58) Field of Search ..... 392/451, 463, 392/441–449

(56) References Cited

U.S. PATENT DOCUMENTS 3,154,248 A * 10/1964 Howard et al. ..... 236/21 B
3,961,156 A * 6/1976 Patton ..... 392/451
3,983,359 A 9/1976 Walker et al.
3,990,299 A 11/1976 Coffman
4,192,456 A 3/1980 Shields et al.
4,366,051 A 12/1982 Fischel
4,398,529 A 8/1983 Schoenfelder
4,503,839 A 3/1985 Dunstan
4,745,945 A 5/1988 Miller
4,805,662 A * 2/1989 Moody ..... 137/312
5,129,034 A 7/1992 Sydenstricker
5,241,981 A 9/1993 Ahern
5,279,319 A 1/1994 Fidelman
5,464,328 A 11/1995 Stoeger
5,720,659 A 2/1998 Wicks
5,931,190 A 8/1999 Engstrom
5,950,653 A 9/1999 Folsom
6,196,246 B1 3/2001 Folsom
6,318,403 B1 11/2001 Fritz

* cited by examiner

*Primary Examiner*—Thor S. Campbell

(57) ABSTRACT

The invention comprises a hot water heater system including a hot water tank, a hot water heater; a pressure relief device which is activated when the hot water heater system is in an overpressure or over-temperature condition; a relief line which is engaged when the pressure relief device is activated; and an output device for providing indicia that the pressure relief device is activated. According to other embodiments, the invention includes means for interrupting or reducing water intake and/or power to the system when in an overpressure or over-temperature state.

25 Claims, 6 Drawing Sheets

SYSTEM AND METHOD FOR WATER HEATER PROTECTION

FIELD OF THE INVENTION

The present invention relates generally to water heater systems, and more particularly, to a system for enhancing the efficiency of water heater systems in overpressure conditions.

BACKGROUND OF THE INVENTION

Conventional hot water heater systems include a hot water tank, a heater module, a power source for heating the water (e.g., electricity, oil, gas, etc.), and water intake and outtake lines. Typical hot water heater systems include a pressure relief valve or similar device that is actuated when the system is in an overpressure or over-temperature condition. When the pressure or temperature exceeds some threshold, the pressure relief device actuates and water and/or gas (e.g., steam or air) is directed out of the hot water tank in order to mitigate the overpressure state. Typically, the pressure relief device will close a line that directs water out of the tank to a disposal area. For example, the line may direct the water into a sump pump area or outside a house in the back yard.

When the pressure relief device actuates, therefore, water begins to be directed out of the system as waste. The efficiency of the system goes down because water is being disposed rather than being used. Therefore, water is wasted.

Also, when the pressure relief device actuates, the water being disposed is water that the hot water system continues to heat. In other words, the hot water system heats up water that is then wasted. Therefore, energy is wasted.

In conventional hot water heater systems, the pressure relief device remains activated until it is deactivated or the system is otherwise reset. As a result, the consumer sees greatly elevated water bills and energy bills until the system is reset.

Conventional hot water heater systems have no indicia or alarm to inform the consumer that the pressure relief device has activated. Typically, therefore, the consumer does not learn that the system is operating in a greatly suboptimal overpressure state until the consumer receives his/her water/energy bills.

Other problems and drawbacks also exist.

SUMMARY OF THE INVENTION

An embodiment of the present invention comprises a hot water heater system including a hot water tank, a hot water heater; a pressure relief device which is activated when the hot water heater system is in an overpressure or over-temperature condition; a relief line which is engaged when the pressure relief device is activated; and an output device for providing indicia that the pressure relief device is activated.

According to one aspect of the invention, the output device may be a display and/or alarm activated when the hot water heater system is in an overpressure or over-temperature state.

According to another embodiment, the invention provides for a hot water heater system including a hot water tank; a hot water heater; a pressure relief device which is activated when the hot water heater system is in an overpressure or over-temperature condition; a relief line which is engaged when the pressure relief device is activated; and means for interrupting water intake when the pressure device is activated.

According to another embodiment, the invention provides for a hot water heater system including a hot water tank; a hot water heater; a pressure relief device which is activated when the hot water heater system is in an overpressure or over-temperature condition; a relief line which is engaged when the pressure relief device is activated; and means for interrupting power to the hot water heater when the pressure relief device is activated.

Accordingly, it is one object of the present invention to overcome one or more of the aforementioned and other limitations of existing systems and methods for providing hot water heater systems.

It object of the invention to provide a hot water heater system that is more efficient regarding water usage.

It is another object of the invention to provide a hot water heater system that is more efficient regarding energy usage.

It is another object of the invention to provide a hot water heater system that provides an indicia to the user or consumer when the system is in an overpressure or over-temperature state.

It is another object of the invention to provide a hot water heater system that interrupts or reduces water intake when the system is in an overpressure or over-temperature state.

It is another object of the invention to provide a hot water heater system that interrupts power to the system is in an overpressure or over-temperature state.

The accompanying drawings are included to provide a further understanding of the invention and are incorporated in and constitute part of this specification, illustrate several embodiments of the invention and, together with the description, serve to explain the principles of the invention. It will become apparent from the drawings and detailed description that other objects, advantages and benefits of the invention also exist.

Additional features and advantages of the invention will be set forth in the description that follows, and in part will be apparent from the description, or may be learned by practice of the invention. The objectives and other advantages of the invention will be realized and attained by the system and methods, particularly pointed out in the written description and claims hereof as well as the appended drawings.

BRIEF DESCRIPTION OF THE DRAWINGS

The purpose and advantages of the present invention will be apparent to those of skill in the art from the following detailed description in conjunction with the appended drawings in which like reference characters are used to indicate like elements, and in which.

DETAILED DESCRIPTION OF THE INVENTION

Figure 1:
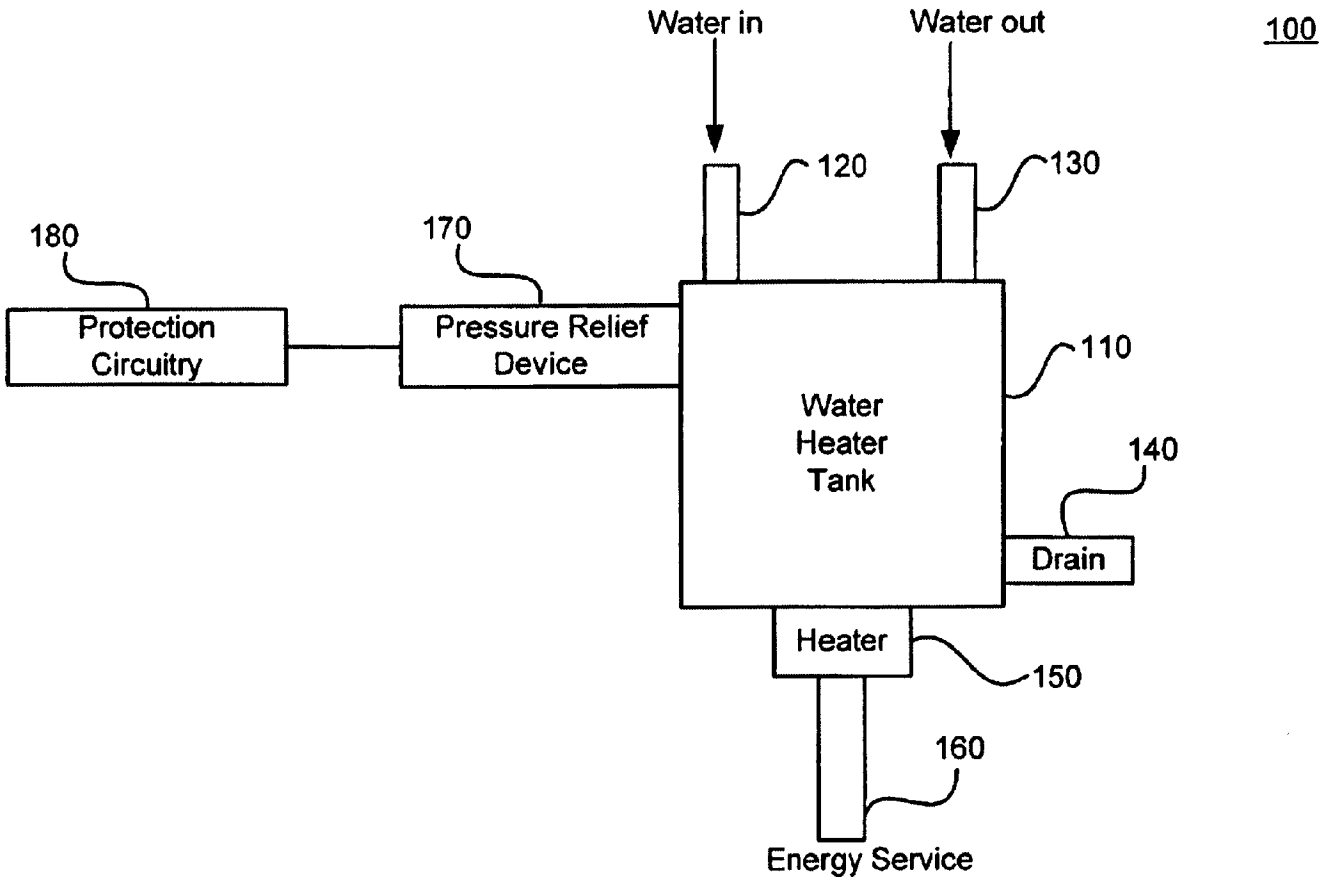
FIG. 1 is a schematic block diagram of a hot water heater system according to an embodiment of the invention.

FIG. 1 is a diagram of an exemplary hot water heater system 100 according to an embodiment of the invention, including water heater tank 110, water intake 120, water outtake 130, drain 140, heater 150, energy source 160, pressure relieve device 170, and protection circuitry 180.

Water heater tank 110 may comprise a conventional hot water heater tank which holds water that is heated for residential or commercial use. Drain 140 is a drain, spigot, valve, or similar device which allows tank 110 to be periodically drained. Heater 150 is a heater which maintains the water in the tank at a preferred temperature. Heater 150 may be an electrical heater, gas heater, oil heater, or similar device. Heater 150 is powered using an energy source 160, such as an electrical source, gas source, oil source, or other source of energy.

Water intake 120 represents pipes or tubes and any related structure which routes the water to the tank 110 from the water source (e.g., local water utility company). Water outtake 130 represents pipes or tubes and any related structure which routes the heated water to its destination. The destination may be a dishwasher, tub, shower, kitchen, or the like in a residential setting. In a commercial setting, the destination may be a bathroom or machinery requiring the use of heated water.

Generally, hot water heater system 100 includes a thermostat or like temperature setting device (not shown) which is set by the user/consumer. Based on the setting, heater 150 is controlled to maintain the temperature according to the setting. Water is drawn in via water intake 120 to maintain the tank in a reasonably full state. When water is requested, the heated water is drawn out via water outtake 130 and routed to its destination. As the tank depletes with water usage, cooler water is drawn in via water intake 120, the temperature drops, and heater 150 is controlled to heat the water back up to the setting.

Water heater system 100 includes a pressure relief device 170, which allows venting of the system in excess pressure or excess temperature conditions. Pressure relief device 170 may comprise a relief valve, a flow switch, or similar device that, when engaged, allows water and/or steam and/or air to escape the system in such conditions. Typically, in such conditions, pressure relief device 170 will engage to allow hot water from the system to escape via a relief line (e.g., pipe or tube) routed to some safe disposal area Further depicted in FIG. 1 is protection circuitry 180, which is activated when the pressure relief device 170 is engaged. Protection circuitry 180 protects the hot water heater system 100 by preventing it from entering a persistent suboptimal state. Protection circuitry 180 may include one or more of the following: an output device(s) for alerting a consumer/user of the overpressure/over-temperature state; a water intake interrupter/reducer to stop/reduce water intake in such states; and a power interrupter/reducer to stop/reduce power input in such states.

Figure 2A:
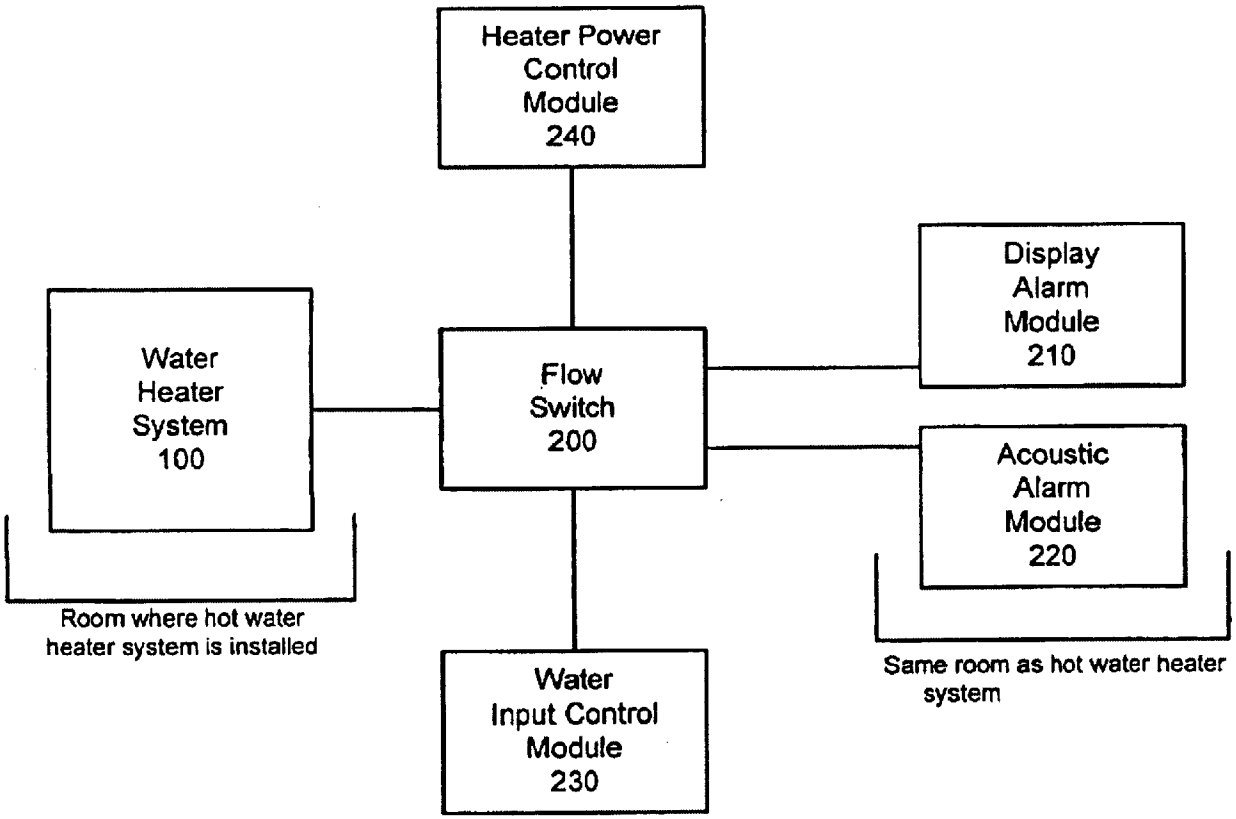
FIGS. 2*a* and 2*b* are schematic block diagrams of a hot water heater system according to embodiments of the invention.
Figure 2B:
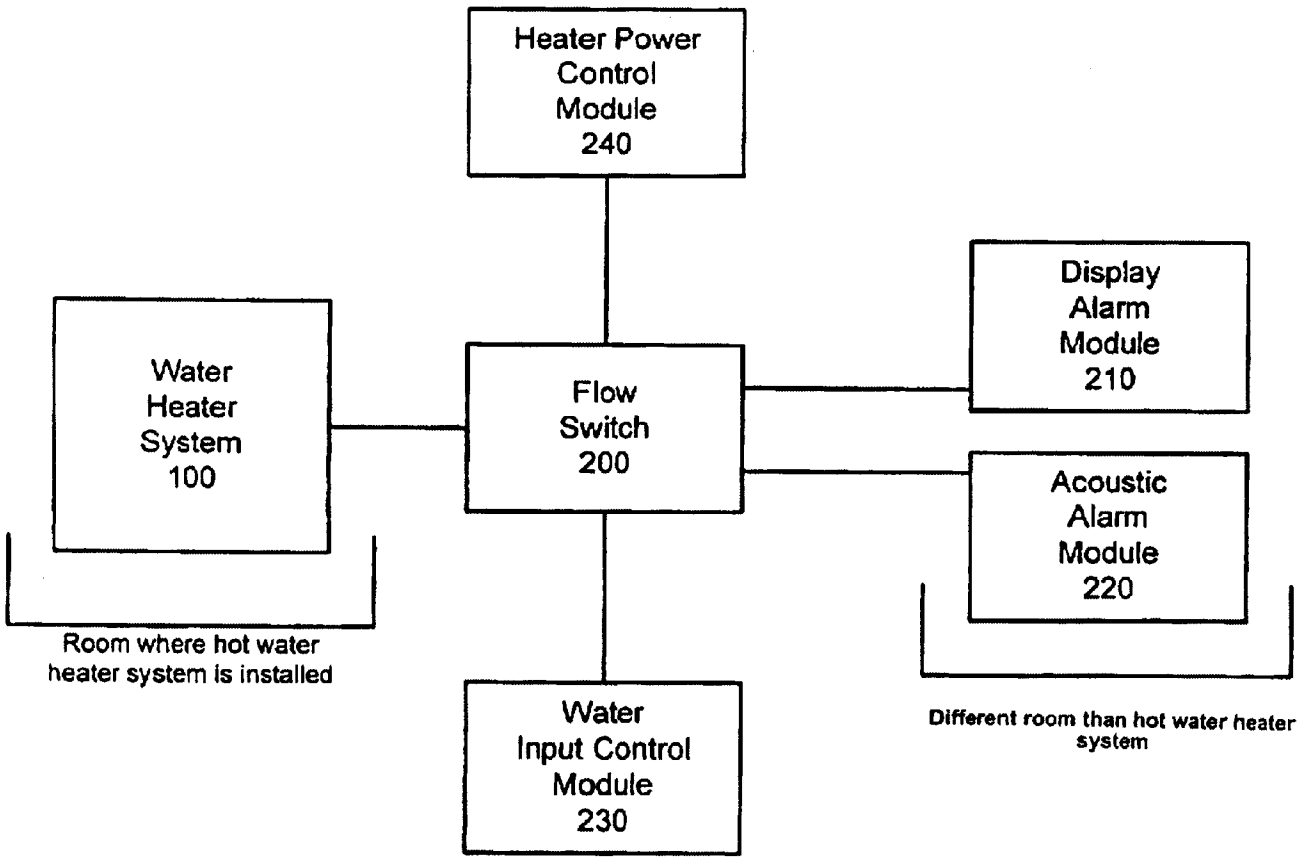

FIG. 2 is a block diagram of an improved hot water heater system including a water heater system 100, flow switch 200, display alarm module 210, acoustic alarm module 220, heater power control module 240, and water input control module 230.

Water heater system 100 generally operates as described above for FIG. 1. When water heater system 100 detects an overpressure or over-temperature state, flow switch 200 is engaged to vent excess water/gas from the tank. When flow switch 200 is activated, one or more alarm devices may be activated, such as display alarm module 210 and/or acoustic alarm module 220.

Display alarm module 210 causes a visual indicia to be presented to the consumer/user when the system is in an overpressure/over-temperature state. The visual indicia may be a light that is turned on or a graphical display (e.g., an LED, LCD, CRT, etc.) that is caused to turn on or to otherwise present a visual indication (e.g., a message presented on an LCD display or CRT) of the state of the system.

Acoustic alarm module 220 causes an acoustic indicia to be presented to the consumer/user when the system is in an overpressure/over-temperature state. The acoustic indicia may be a ringing alarm, a buzzing sound, or any other audible sound for reliably alerting the user/consumer to the state of the system.

In addition to (or instead of) the alarm devices, when flow switch 200 of FIG. 2 is activated, one or more interruption/reducer modules may be activated, such as heater power control module 240 and/or water input control module 230.

Heater power control module 240 controls the power applied to hot water heater system 100 when in an overpressure or over-temperature state. In particular, heater power control module 240 may interrupt or reduce the power applied to heater 150 when flow switch 200 of FIG. 2 (or pressure relief device 170 of FIG. 1) is engaged. The power can be completely shut off or, alternatively, can be reduced (e.g., reduced to a level that ensures that the water will not freeze, but otherwise avoids undue energy loss).

Just by way of example, water heater system 100 may be set to maintain the temperature at 120 degrees Fahrenheit. If an overpressure or over-temperature state is detected, heater power control module 240 may control heating in one of several possible fashions. For example, heater power control module 240 could simply provide that the power provided to heater 150 is cut off. Alternatively, heater power control module 240 could provide that the power is reduced by some amount, such as by 50%. Or alternatively, heater power control module 240 could simply reduce the thermostat setting to a lower setting, such as to 80 degrees Fahrenheit. This last approach would greatly reduce the energy waste, while ensuring that the water be maintained at a temperature avoiding freezing in the tank or in the relief line extending away from the tank (e.g., disposing the water outdoors).

Water input control module 230 controls the water allowed into the hot water heater system 100 when in an overpressure or over-temperature state. In particular, water input control module 230 may cut off or reduce the amount of water drawn in via water intake 120 in such circumstances. According to one approach, the water supply would be entirely cut off. According to another approach, the water supply would be reduced. For example, water input control module 230 may provide that the tank 110 be maintained in a partially full state. For example, if tank 110 is a 50 gallon tank, water input control module 230 might provide that the tank be maintained at only 20 or 30 gallons when the system has entered an overpressure or over-temperature state.

Figure 3:
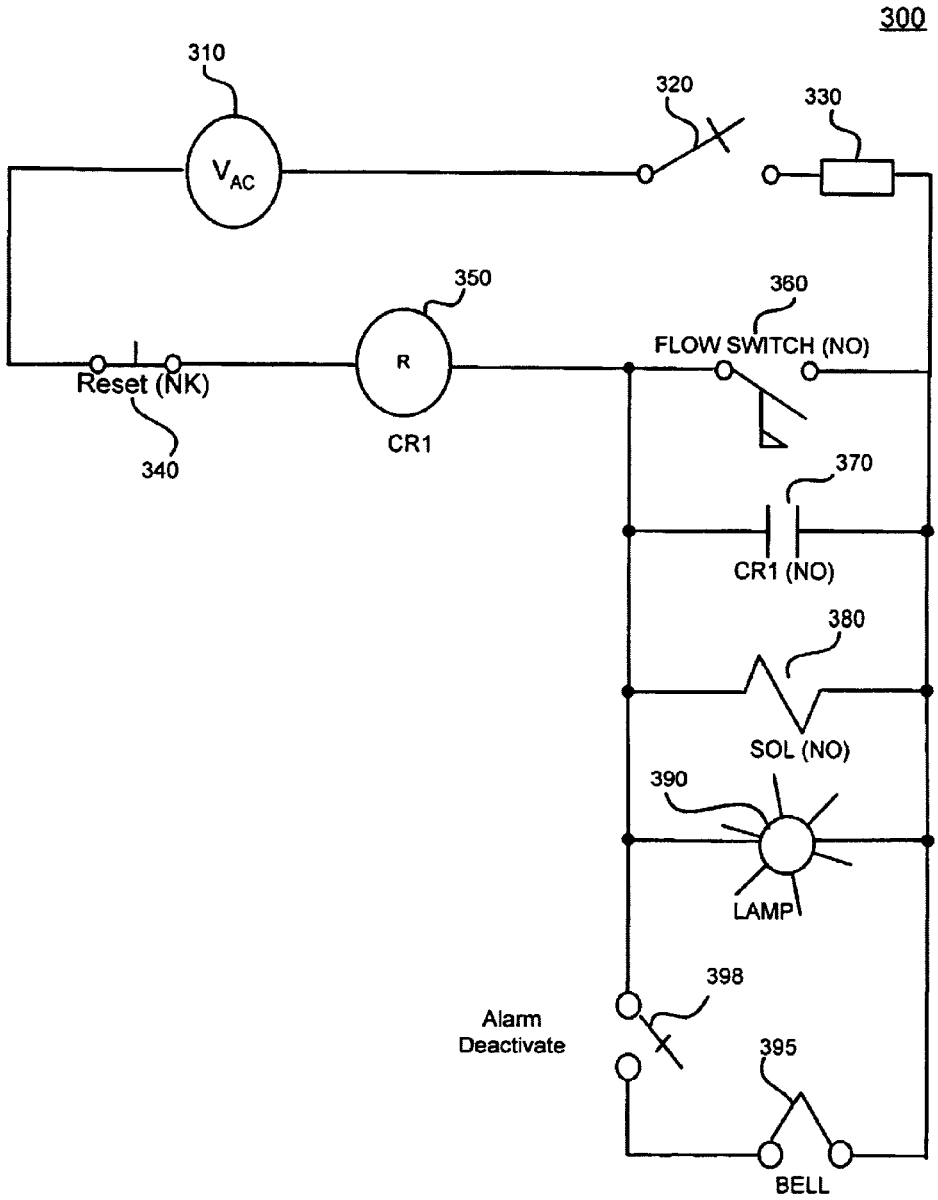
FIG. 3 is a circuit diagram of protection circuitry according to yet another embodiment of the invention.

FIG. 3 is an exemplary circuit diagram implementing protection circuitry 180 according to an exemplary embodiment of the invention. Protection circuit 300 of FIG. 3 includes the following: AC power source 310; main on/off switch 320; fuse 330; reset button 340; control relay coil 350; flow switch 360; contact 370; solenoid valve 380; lamp 390; bell 395; and alarm deactivate 398.

AC power source 310 is an AC power source, such as a 110 AC residential power source.

Main on/off switch 320 is a switch for turning the entire protection circuit 300 on or off. Turning circuit 300 off may be desirable if the overall circuit is believed to be defective, or for testing purposes, or for replacement of spent components. Fuse 330 is a conventional electrical fuse used to protect circuit 300 in overcurrent conditions.

Reset button 340 is a reset button for resetting circuit 300. According to one embodiment, reset button 340 is a so-called momentary reset button, well-known in the art, which interrupts the circuit when the button is engaged and then reengages the circuit when the button is released. Reset button 340 may be a spring-loaded device.

Control relay coil 350 is a control relay coil that is energized in response to flow switch 360 closing.

Flow switch 360 is a flow switch device that responds to engagement of the pressure relief device (e.g., pressure relief device 170 of FIG. 1). Particularly, when an overpressure or over-temperature condition is detected, pressure relief device 170 opens in order to allow water to vent through the relief line. In response, flow switch 360, which is normally open, is caused to close. (For example, flow switch 360 may be installed in the relief line in order to carry out this operation.) By closing, flow switch 360 energizes circuit 300, as discussed further below. Flow switch 360 can be selected as an suitable flow switching device, which might be mechanical, electrical/electronic, Hall Effect, and so forth.

Contact 370 is an electrical contact. According to one embodiment, contact 370 is normally open, but will close upon closing of flow switch 360 and energizing of circuit 300.

Solenoid valve 380 is a solenoid-type device that is controlled to open or close based on the state of circuit 300. Solenoid valve 380 is located to control water intake 120 (e.g., solenoid valve 380 may be located in series with water intake 120) so that when solenoid valve 380 is open, water can enter hot water heater system 100, whereas when solenoid valve 380 is closed, water does not enter hot water heater system 100. Preferably, solenoid valve 380 is normally open, but is caused to close when circuit 300 is energized (discussed further below).

Lamp 390 comprises one form of output device for alerting a user/consumer when the hot water heater system 100 is in an overpressure/over-temperature state. Lamp 390 may comprise a display device such as a conventional filament-type light, neon-type light, LED type light, or other lighting device. Lamp 390 may comprise a display device such as a Liquid Crystal Display, monitor/CRT, or other display device which can display an indicia reflecting the state of the system. Lamp 390 may display a message indicating to the user/consumer the state of the system. Lamp 390 may be located adjacent to hot water heater system 100 (e.g., in the same room), or lamp 390 may be located separate from hot water heater system 100 (e.g., in a residential setting, lamp 390 may be located in the kitchen or another room separate from the room where the hot water heater system 100 is located).

Bell 395 comprises another form of output device for alerting a user/consumer regarding the state of hot water heater system 100. Preferably, bell 395 is an alarm device that goes off when the system 100 is in an overpressure/over-temperature state. Preferably, bell 395 emanates an acoustic sound that is sufficiently loud and distinctive (e.g., a loud buzzing or ringing sound) to alert a user/consumer.

Alarm deactivate 398 is a switch that can be used to activate/deactivate the bell 395. Once the user/consumer is alerted, he/she may wish to open switch 398 in order to turn the bell 395 off. Although not depicted in FIG. 3, a similar switch could be beneficially implemented in the line between solenoid 380 and lamp 390 so that the visual alarm could be turned off as well.

Having described the components of an exemplary protection circuit 300 of FIG. 3, the operation is now described. When an overpressure/over-temperature condition is detected, a pressure relief device (e.g., pressure relief device 170 of FIG. 1) opens to allow water (and/or steam and/or air) to pass through a relief line. Flow through the relief line causes the normally-open flow switch 360 of FIG. 3 to close. Closing of flow switch 360 energizes circuit 300, in particular, coil relay 350 is energized. This causes normally-open contact 370 to close.

As a result, normally-open solenoid valve 380 is caused to close partially (cutting off a portion of the water supply via intake 120) or fully (fully cutting off water supply via intake 120). Therefore, the entry in the overpressure/over-temperature state results in the water supply being reduced/cut off so as to avoid unnecessary water waste.

Closing of contact 370 also engages lamp 390. Therefore, the entry in the overpressure/over-temperature state results in a visual alert being provided to the user/consumer.

Similarly, closing of contact 370 also engages bell 395 so that entry in the overpressure/over-temperature state results in an audible alert being provided to the user/consumer.

The circuit can be deactivated by actuating reset button 340, which resets the circuit. This causes flow switch 360 to return to the open position, and the circuit is de-energized. De-energizing the circuit 300 results in solenoid 380 re-opening (allowing the normal intake of water), the lamp 390 to turn off, and the bell 395 to turn off. Of course, if the hot water heater system 300 continues to detect an overpressure/over-temperature state, the circuit 300 will re-energize and the process repeats (water intake reduced/cut off, light turns on, alarm rings, etc.).

Normally, once alerted that the system 100 has entered an overpressure/over-temperature state, the user/consumer will reset the pressure relief device 170 (e.g., heater relief valve) to a closed position so that venting will cease.

Figure 4:
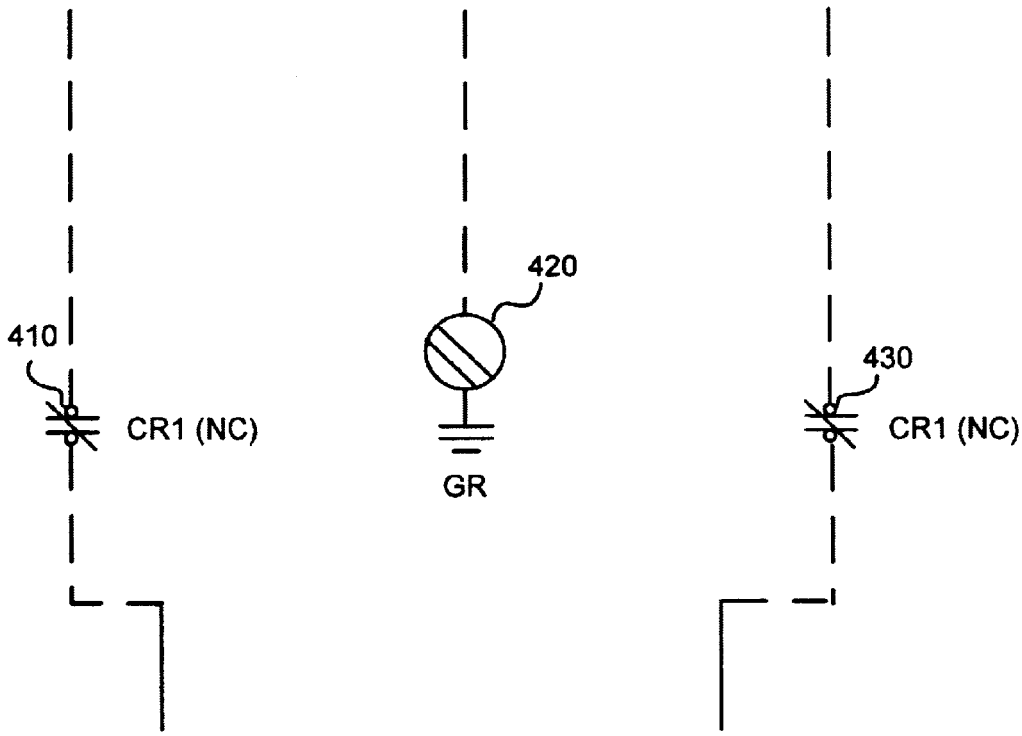
FIG. 4 is a circuit diagram of additional protection circuitry according to yet another embodiment of the invention.

FIG. 4 is a diagram illustrating circuitry which can be implemented to shut off or reduce the power to hot water heater system 100 in overpressure/over-temperature conditions. The circuit 400 of FIG. 4 may be implemented in parallel with the circuit 300 of FIG. 3 between an electrical distribution panel and the water heater 150. According to the exemplary embodiment of FIG. 4, circuit 400 includes normally-closed contacts 410/430 and ground 420. In their normal state, these contacts permit power to flow to heater 150 of FIG. 1. When protection circuit 300 of FIG. 3 is energized, the contacts 410/430 of FIG. 4 open, resulting in power being shut off. Therefore, when heater system 100 enters an overpressure/over-temperature state, power is cut off to avoid energy waste. As discussed previously, rather than cutting off power entirely, power may be cut off partially (e.g., set to 50% of normal power or by reducing the thermostat setting). In such an embodiment, components other than open/close type contacts may be employed (e.g., a variable resistance type device may be employed).

Figure 5:
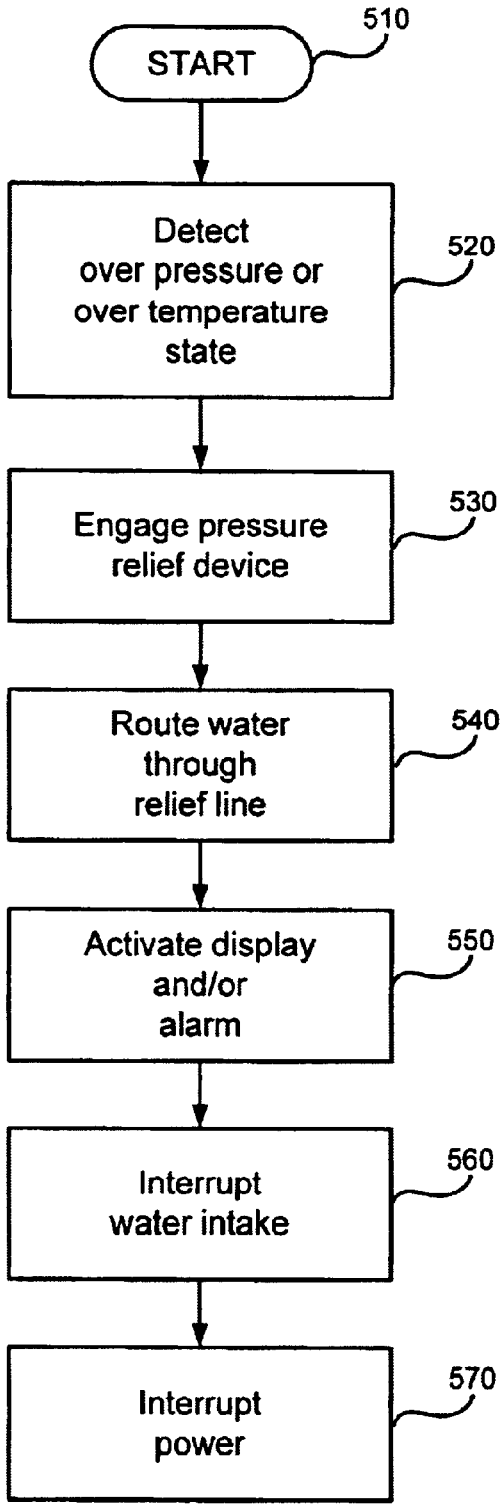
FIG. 5 illustrates a method for protecting a hot water heater system according to an embodiment of the invention.

FIG. 5 is a flow diagram of a method for controlling operation of a hot water heater system according to an embodiment of the invention. The method begins at 510. At 520, the hot water heater system detects an overpressure and/or over-temperature state. At 530, a pressure relief device is engaged (e.g., pressure relief device 170 of FIG. 1), and water is permitted to escape through a relief line at 540. Based on the detection of an overpressure and/or over-temperature state, at 550 a visual display device (e.g., display alarm module 210 of FIG. 2) and/or acoustic alarm device (e.g., acoustic alarm module 220 of FIG. 2) is activated. Similarly, at 560 the water intake to the hot water heater system is interrupted or reduced (e.g., water input control module 230 of FIG. 2). Similarly, at 570 the power provided to the hot water heater is interrupted or reduced (e.g., heater power control module 240).

Having described a hot water heater protection system, a number of beneficial applications and advantages are apparent, including, but not limited to the following: reduction of water usage; reduction of energy usage; and earlier recognition that the hot water heater system has engaged a relief line so that the user/consumer can take remedial measures.

Other embodiments and uses of this invention will be apparent to those having ordinary skill in the art upon consideration of the specification and practice of the invention disclosed herein. The specification and examples given should be considered exemplary only, and it is contemplated that the appended claims will cover any other such embodiments or modifications as fall within the true scope of the invention.

What is claimed is:

1. A hot water heater system, comprising:

a hot water tank;

a hot water heater;

a pressure relief device which is activated when the hot water heater system is in an overpressure or overtemperature condition;

a detector for detecting activation of the pressure relief device;

a relief line which is engaged when the pressure relief device is activated; and an output device operatively coupled to said detector for providing at least one of audio and electronically-generated visual indicia that the pressure relief device is activated.

2. The hot water heater system of claim 1, wherein the output device is a display device.

3. The hot water heater system of claim 1, wherein the output device is an alarm.

4. The hot water heater system of claim 1, wherein the detector is a flow switch.

5. The hot water heater system of claim 1, wherein the output device is a display device located in a room other than where the hot water heater system is installed.

6. The hot water heater system of claim 1, wherein the output device is an alarm device located in a room other than where the hot water heater system is installed.

7. A hot water heater system, comprising:

a hot water tank;

a hot water heater;

a pressure relief device which is activated when the hot water heater system is in an overpressure or overtemperature condition;

a detector for detecting activation of the pressure relief device;

a relief line which is engaged when the pressure relief device is activated; and means for interrupting or reducing water intake operatively coupled to said detector when the pressure relief device is activated.

8. The hot water heater system of claim 7, wherein the means for interrupting or reducing comprises a valve that shuts off or reduces the water intake.

9. The hot water heater system of claim 8, wherein the detector is a flow switch.

10. A hot water heater systems comprising:

a hot water tank;

a hot water heater;

a pressure relief device which is activated when the hot water heater system is in an overpressure or overtemperature condition;

a detector for detecting activation of the pressure relief device;

a relief line which is engaged when the pressure relief device is activated; and means for interrupting or reducing power to the hot water heater when the pressure relief device is activated, said means being operatively coupled to said detector.

11. The hot water heater system of claim 10, wherein the means for interrupting or reducing power comprises one or more contacts which open in order to interrupt power flow when the pressure relief device is activated.

12. The hot water heater system of claim 10, wherein the means for interrupting or reducing power comprises one or more variable resistance devices which interrupt or reduce power flow when the pressure relief device is activated.

13. A hot water heater system, comprising:

a hot water tank;

a hot water heater;

a pressure relief device which is activated when the hot water heater system is in an overpressure or overtemperature condition;

a detector for detecting activation of the pressure relief device;

a relief line which is engaged when the pressure relief device is activated; and means for interrupting or reducing water intake when the pressure device is activated, said means for interrupting or reducing being operatively coupled to said detector; and means for interrupting or reducing power to the hot water heater when the pressure relief device is activated, said means for interrupting or reducing being operatively coupled to said detector.

14. The hot water heater system of claim 13, wherein the means for interrupting water intake comprises a valve that blocks or reduces water intake when the pressure device is activated, and the means for interrupting power comprises one or more contacts which open in order to interrupt power flow when the pressure relief device is activated.

15. A hot water heater system, comprising:

a hot water tank;

a hot water heater;

a pressure relief device which is activated when the hot water heater system is in an overpressure or overtemperature condition;

a detector for detecting activation of the pressure relief device;

a relief line which is engaged when the pressure relief device is activated; and means for interrupting or reducing water intake when the pressure device is activated, said means for interrupting or reducing water intake being operatively coupled to said detector; and means for interrupting or reducing power to the hot water heater when the pressure relief device is activated, said means for interrupting or reducing power being operatively coupled to said detector; and an output device operatively coupled to said detector for providing at least one of audio and electronically-generated visual indicia that the pressure relief device is activated.

16. The hot water heater system of claim 15, wherein the output device comprises a display device.

17. The hot water heater system of claim 15, wherein the output device is an alarm.

18. The hot water heater system of claim 15, wherein the output device comprises a display device and an alarm.

19. A method of controlling a hot water heater system, comprising:

heating water in a hot water tank;

activating a pressure relief device when the hot water heater system is in an overpressure or over-temperature condition:

detecting the activation of the pressure relief device using a detector;

routing water through a relief line based on the detecting step; and actuating an output device operatively coupled to the detector and providing at least one of audio and electronically-generated visual indicia that the pressure relief device is activated.

20. The method of claim 19, wherein the output device comprises a display device.

21. The method of claim 19, wherein the detector is a flow switch.

22. The method of claim 19, wherein the output device comprises a display device and an alarm.

23. The method of claim 19, further comprising interrupting or reducing water intake to the hot water system based on the detecting step.

24. The method of claim 19, further comprising interrupting or reducing power to the hot water system based on the detecting step.

25. The method of claim 19, further comprising interrupting or reducing water intake to the hot water system and interrupting power to the hot water system based on the detecting step.

* * * * *